US007060920B2

(12) United States Patent
Serizawa et al.

(10) Patent No.: US 7,060,920 B2
(45) Date of Patent: Jun. 13, 2006

(54) MULTI-STAGE CLICK SWITCH

(75) Inventors: Yasuyoshi Serizawa, Shizuoka (JP); Minoru Kubota, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 206 days.

(21) Appl. No.: 09/989,373

(22) Filed: Nov. 21, 2001

(65) Prior Publication Data

US 2002/0066650 A1 Jun. 6, 2002

(30) Foreign Application Priority Data

Dec. 6, 2000 (JP) ..... P2000-371760

(51) Int. Cl.
*H01H 29/16* (2006.01)

(52) U.S. Cl. ..... 200/200; 200/1 B; 200/5 R; 200/5 A; 200/512

(58) Field of Classification Search ..... 200/200, 200/1 B, 5 R, 5 A, 512, 513, 514, 515, 516, 200/517, 339, 17 R
See application file for complete search history.

(56) References Cited

U.S. PATENT DOCUMENTS 4,401,864 A * 8/1983 Ichikawa ..... 200/17 R
5,115,108 A * 5/1992 Ogawa et al. ..... 200/1 B
5,430,261 A 7/1995 Malone
5,510,584 A * 4/1996 Norris ..... 200/5 A
5,719,361 A 2/1998 Lee

FOREIGN PATENT DOCUMENTS

| | | |
|---|---|---|
| DE | 33 40 575 C2 | 11/1983 |
| DE | 41 04 572 C2 | 8/1991 |
| DE | 195 37 296 A1 | 4/1996 |
| DE | 196 00 657 C1 | 4/1997 |

* cited by examiner

*Primary Examiner*—Lincoln Donovan
*Assistant Examiner*—Jennifer A. Poker
(74) *Attorney, Agent, or Firm*—Sughrue Mion, PLLC

(57) ABSTRACT

A multi-stage click switch (21) includes a contact circuit member (25) having switch contact portions (41*a*, 41*b*, 42*a* and 42*b*) disposed respectively in opposed relation to pressing portions (36*a*, 36*b*, 37*a* and 37*b*) formed on an operating knob (35) mounted on a housing (32), and a rubber switch member (30) having rubber contact portions (28*a*, 28*b*, 29*a* and 29*b*) which can sequentially close and open the switch contact portions in a multi-stage manner in accordance with the movement of the pressing portions. Each of the rubber contact portions produces a suitable click feeling by a resilient force, produced by elastic deformation of the rubber contact portion, at the time of operating the operating knob (35). The rubber contact portion (28*a*) has overstroke means by which after its conductive piece (22*a*, 23*a*) contacts the opposing switch contact portion (41*a*, 42*a*), a click feeling is not produced until the switching operation of the rubber contact portion (28*b*, 29*b*) is completed.

5 Claims, 7 Drawing Sheets

MULTI-STAGE CLICK SWITCH

BACKGROUND OF THE INVENTION

This invention relates to an improved multi-stage click switch which produces a suitable click feeling in a multi-stage manner when operating an operation knob.

As shown in FIGS. 9 and 10, one example of related switches for controlling the operation of various electric equipments (such as a power window mechanism), mounted, for example, on a door trim of a car door, is a two-stage click switch 1 which produces a suitable click feeling when pivotally operating an operating knob 11.

This two-stage click switch 1 disclosed in Japanese Patent No. 2792571, comprises: a housing 2; a pair of pressing members 10 and 12 forwardly and backwardly-movably mounted on the housing 2 in spaced relation to each other; the operating knob 11 for moving the pressing members 10 and 12 downward; a contact circuit member 3, which is mounted on the housing 2 in opposed relation to the pressing members 10 and 12 and the operating knob 11, and has two pairs of contact portions 14*a*, 14*b* and 16*a*, 16*b* each pair of which are disposed in opposed relation to a respective one of the pressing members 10 and 12; and a rubber switch member 9 provided between the contact circuit member 3 and the pressing members 8 and 10.

The rubber switch member 9 has two pairs of rubber contact portions 5*a*, 5*b* and 7*a*, 7*b* each pair of which can sequentially close and open the corresponding pair of contact portions 14*a* and 14*b* (16*a* and 16*b*) upon forward and backward movement of the corresponding pressing member 8, 10. A pair of conductive pieces 6*a* and 6*b* (8*a* and 8*b*) are provided within each pair of rubber contact portions 5*a* and 5*b* (7*a* and 7*b*), respectively, in opposed relation to the contact portions 14*a* and 14*b* (16*a* and 16*b*). The distance $L_1$ between the conductive piece 6*a*, 8*a* and the contact portion 14*a*, 16*a* is smaller than the distance $L_2$ between the other conductive piece 6*b*, 8*b* and the contact portion 14*b*, 16*b* ($L_1<L_2$)

The rubber contact portion 5*a*, 7*a*, after pressed into contact with the contact portion 14*a*, 16*a*, can still advance a small distance, and the rubber contact portion 5*a*, 7*a* of the overstroke type can absorb an operating stroke difference due to the distances $L_1$ and $L_2$. Namely, the rubber contact portion 5*a*, 7*a* includes two-stage operating means 19 which is operable in a two-stage manner while absorbing the operating stroke difference.

The operating knob 11 is pivotally supported by a pair of support shafts 2*a* and 2*a* formed on the housing 2. The operating knob, when pivotally moved in a clockwise direction (FIG. 9), advances the pressing member 12, thereby moving a window glass pane upward, and when this operating knob is pivotally moved in a counterclockwise direction, it advances the pressing member 10, thereby moving the window glass pane downward.

For example, when the operating knob 11 is pivotally moved in the clockwise direction (FIG. 9), the pressing member 12 advances downward to descend the rubber contact portions 7*a* and 7*b*. In this descending operation, the conductive piece 8*a* is first pressed into contact with the manually-ascending contact portion 16*a* to achieve a first-stage operating condition, thereby rendering this contact portion into a conducting state. When this condition is maintained, the window glass pane is ascending.

Then, when the operating knob 11 is returned to its initial position, the conductive piece 8*a* moves upward apart from the contact portion, so that the window glass pane ceases to ascend. Alternatively, when the operating knob 11 is further pivotally moved through a predetermined angle in the clockwise direction, the rubber contact portion 7*a*, serving as the two-stage operating means 19, is further flexed after the above press contact, thereby absorbing the stroke difference, so that the rubber contact portion 7*b* continues to descend, and the conductive piece 8*b* is pressed into contact with the automatically-ascending contact portion 16*b* to achieve a second-stage operating condition, and the window glass pane automatically moves upward to an upper limit.

In the case of the switch thus operable in a two-stage manner, unless a click feeling, capable of detecting the operating condition of each stage, is provided, an operation error is incurred.

Therefore, the operating knob 11 is provided with a click producing mechanism 18 which comprises a compression spring 15 and a pin 13 which are provided in a mounting hole provided at a central portion of the operating knob. A suitable click feeling can be obtained by the friction between the pressing pin 13 and a V-shaped receiving groove 17. Each of the rubber contact portions 5*a*, 5*b*, 7*a* and 7*b* has a generally bowl-shaped cross-section, and is of the clickless type so as to be elastically deformed without affecting a click feeling produced by the click producing mechanism 18.

However, since the pressing pin 13 and the compression spring 15 of the click producing mechanism 18 are contained in the operating knob 11, the height dimension of the operating knob 11 increases.

Therefore, the pressing member 10, 12 for transmitting the pressing force need to be provided between the rubber contact portions 5*a* and 5*b* (7*a*, 7*b*) and a rubber switch pressing portion 11*a*, 11*b*.

Therefore, the number of the component parts of the two-stage click switch 1 increases because of the component parts of the click producing mechanism 18 and the pressing members 10 and 12, so that it is encountered a problem that the time and labor, required for the assembling operation, increased, and the production cost increases.

Further, the two-stage click switch 1 makes it difficult to form the whole of the unit into a compact design (for example, a space-saving design when it is mounted on a vehicle).

SUMMARY OF THE INVENTION

It is therefore an object of this invention to solve the above problems, and more specifically to provide a multi-stage click switch in which the number of component parts is reduced, and a compact design can be achieved, and this click switch is inexpensive and highly reliable.

The above object of the present invention has been achieved by a multi-stage click switch comprising:

a housing;

an operating knob movably mounted on the housing;

a plurality of pressing portions provided on the operating knob;

a contact circuit member including a plurality of switch contact portions disposed in opposed relation to the plurality of pressing portions, respectively;

a rubber switch member provided between the plurality of pressing portions and the contact circuit member;

a plurality of rubber contact portions which are formed on the plurality of rubber switch member, and can sequentially close and open the switch contact portions in multi-stage manner in accordance with the movement of the plurality of pressing portions, wherein each of the plurality of rubber contact portions produces a click feeling by a resilient force, produced by elastic deformation of the rubber contact portion during the movement of the operating knob, at the time of operating the operating knob, and includes a conductive piece opposed to corresponding one of the plurality of switch contact portions; and over stroke means which is capable of elastic deformation of a lower resilient force, not producing a click feeling, and is provided to the at least one rubber contact portion except the at least one rubber contact portion effecting a final-stage switching operation, for allowing the movement of the operating knob until the final-stage switching operation is completed.

In the above construction, a click feeling is produced by the resilient force produced when the rubber contact portion itself is elastically deformed, and therefore it is not necessary to provide a click producing mechanism, comprising special parts, as used in the conventional switch.

Therefore, the number of the component parts, as well as the time and labor for the assembling operation, is reduced, so that the production cost can be reduced. And besides, it is not necessary to provide such a click producing mechanism, comprising separate members, between the operating knob and the rubber switch member, and therefore the whole of a switch unit can be formed into a compact design.

A click feeling can be easily produced in a multi-stage manner in accordance with the number of the rubber contact portions.

The operating knob is pivotally mounted on the housing, and the plurality of pressing portions are formed on and project from the reverse surface of the operating knob at pivotally-moving opposite end portions thereof. With this construction, there can be provided the multi-stage clicks witch of the pivotally-moving type which is compact and inexpensive.

DETAILED DESCRIPTION OF PREFERRED EMBODIMENTS

One preferred embodiment of a multi-stage click switch of the present invention will now be described in detail with reference to the accompanying drawings.

Figure 1A:
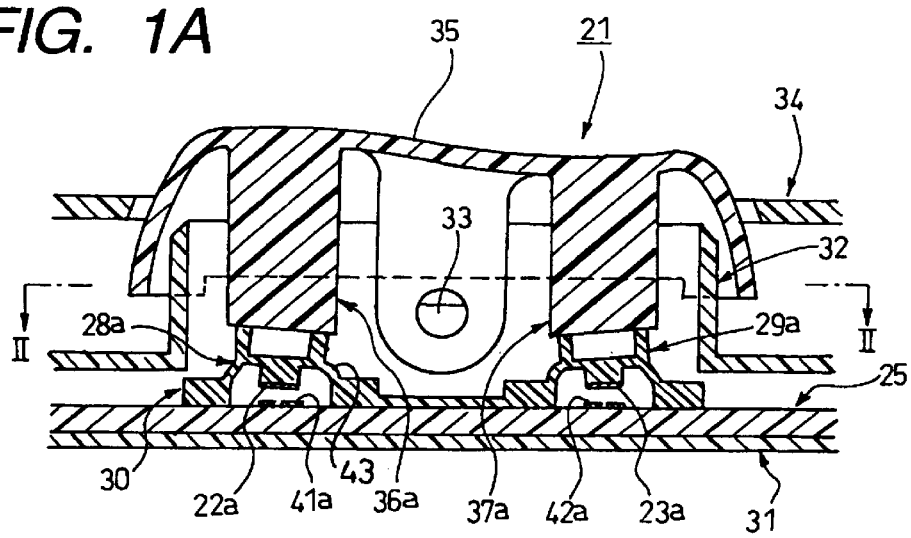
FIGS. 1A and 1B are cross sectional views of a first embodiment of a multi-stage click switch of the present invention.
Figure 1B:
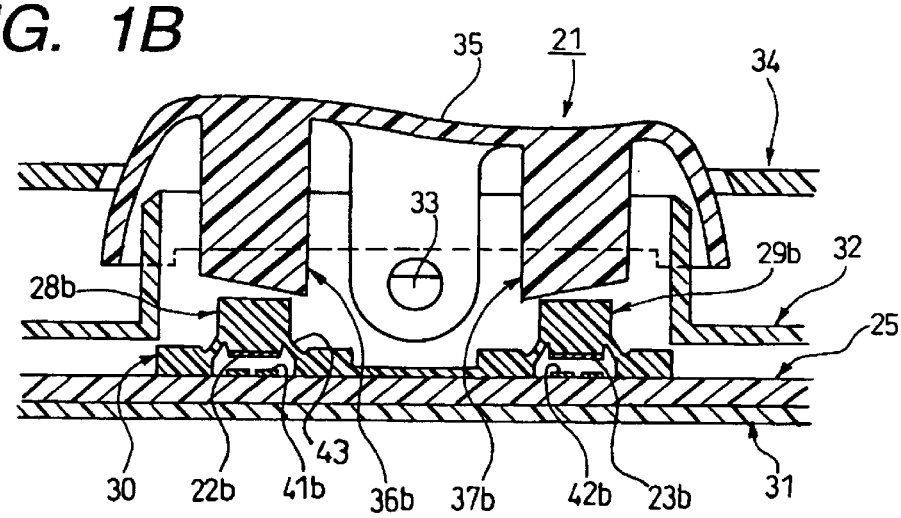
Figure 2:
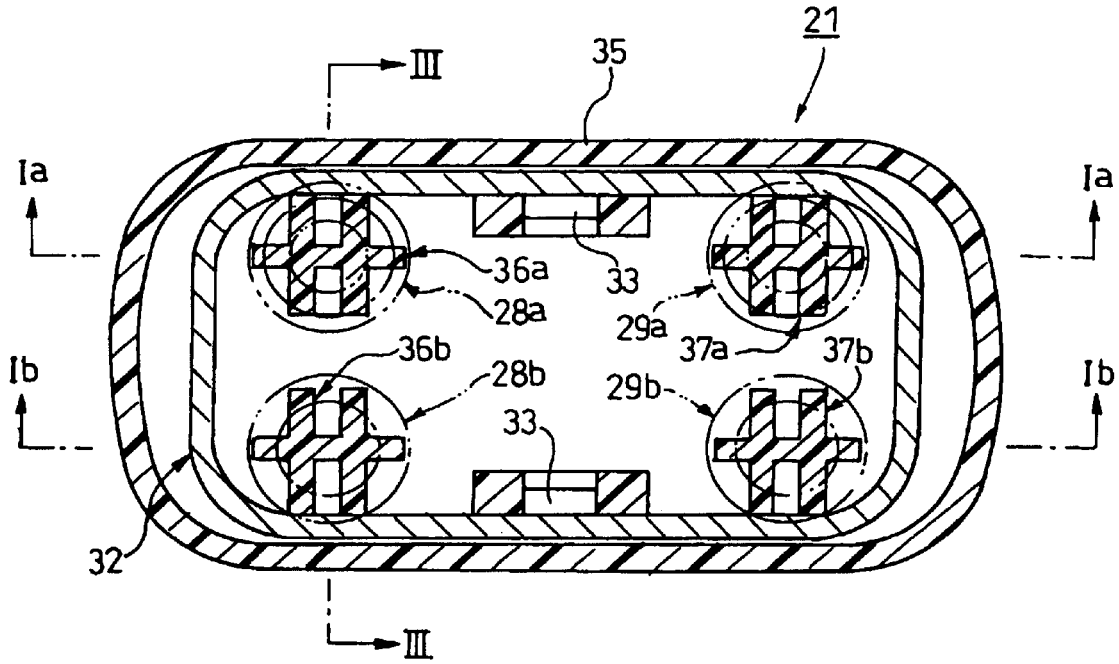
FIG. 2 is a cross-sectional view taken along the line II—II of FIG. 1.
Figure 3:
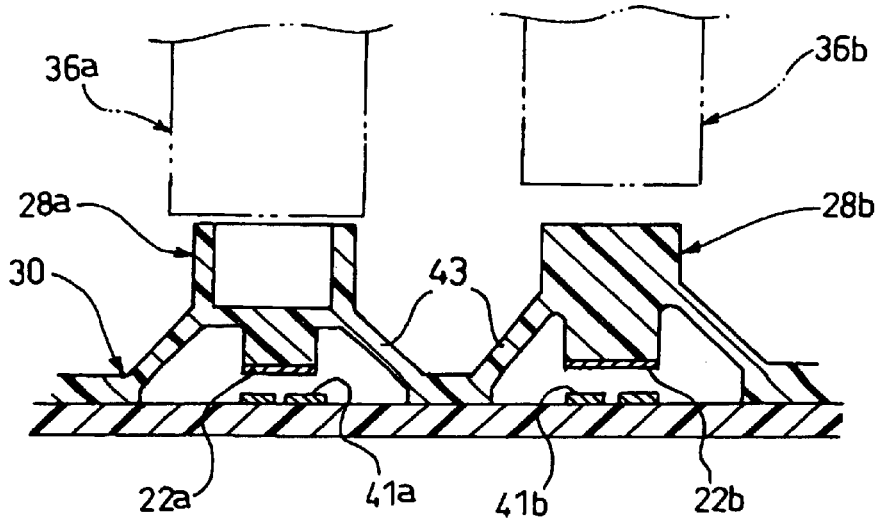
FIG. 3 is an enlarged, cross-sectional view of an important portion, taken along the line III—III of FIG. 2.
Figure 4:
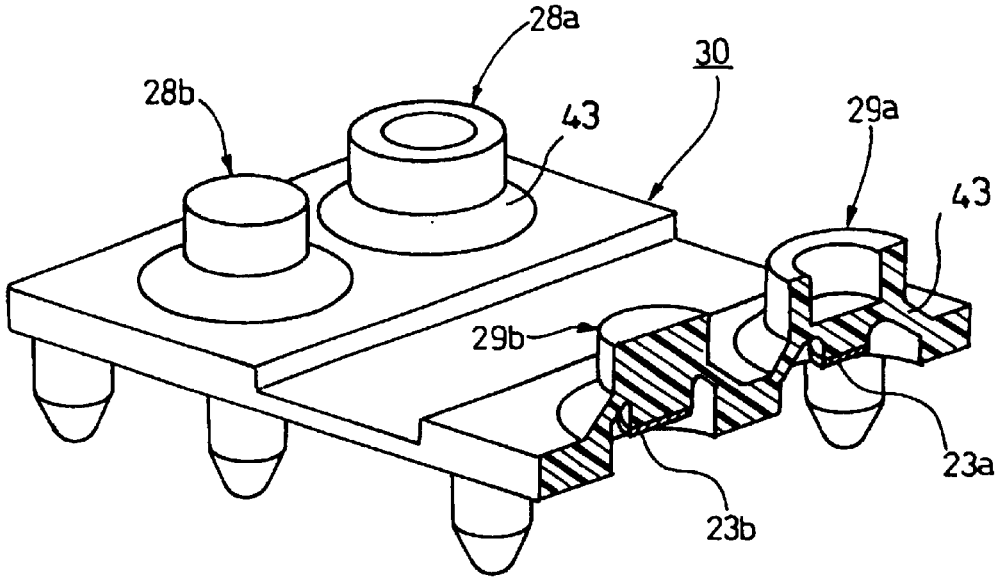
FIG. 4 is a partly-broken, perspective view of a rubber switch member shown in FIG. 3.
Figure 5A:
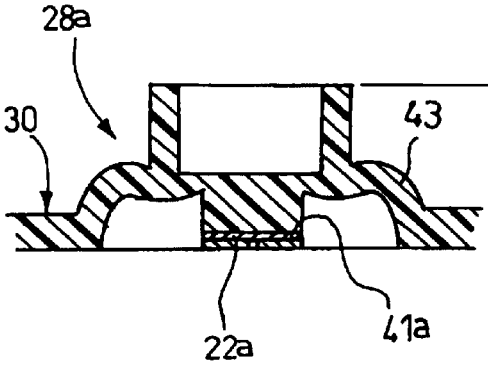
FIGS. 5A and 5B are cross-sectional views explanatory of an overstroke operation of a rubber contact portion shown in FIG. 3.
Figure 5B:
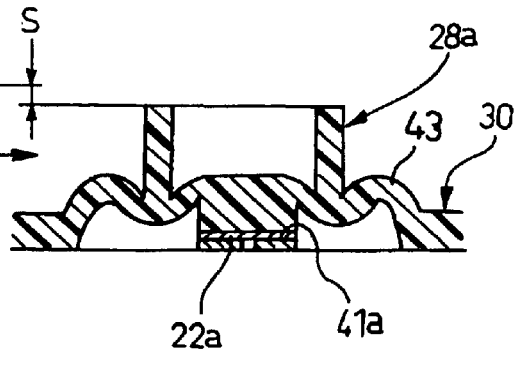

FIGS. 1A and 1B are a cross-sectional view of the multi-stage click switch according to the first embodiment of the invention, FIG. 2 is a cross-sectional view taken along the line II—II of FIG. 1, FIG. 3 is an enlarged, cross-sectional view of an important portion, taken along the line III—III of FIG. 2, FIG. 4 is a partly-broken, perspective view of a rubber switch member shown in FIG. 3, FIGS. 5A and 5B are a cross-sectional views explanatory of an overstroke operation of a rubber contact portion shown in FIG. 3, and FIGS. 6A, 6B, 7A and 7B are cross-sectional views explanatory of the operation of the multi-stage click switch of FIG. 1.

The multi-stage click switch 21 according to this first embodiment is a pivotally-moving switch capable of achieving a two-stage click operation, and this multi-stage click switch of the pivotally-moving type can be suitably used, for example, as a switch for a power window of a vehicle.

As shown in FIGS. 1 and 2, the multi-stage click switch 21 in this first embodiment comprises: a housing 32; an operating knob 35 pivotally mounted by support shafts 33 of the housing 32; two pairs of forwardly and backwardly-movable pressing portions 36*a*, 36*b* and 37*a*, 37*b* each pair of which are formed on and project from a reverse surface of the operating knob 35 at a respective one of pivotally-moving opposite end portions thereof; a contact circuit member 25 having a plurality of switch contact portions 41*a*, 41*b*, 42*a* and 42*b* disposed in opposed relation to the pressing portions 36*a*, 36*b*, 37*a* and 37*b*, respectively; the rubber switch member 30 provided between the contact circuit member 25 and the pressing portions 36*a*, 36*b*, 37*a* and 37*b*; and two pairs of rubber contact portions 28*a*, 28*b* and 29*a* and 29*b* which are formed on the rubber switch member 30, and each pair of rubber contact portions 28*a* and 28*b* (29*a* and 29*b*) can sequentially close and open the corresponding switch contact portions 41*a* and 41*b* (42*a* and 42*b*) in a multi-stage manner (in a two-stage manner in this embodiment) in accordance with the forward and backward movement of the corresponding pressing portions 36*a* and 36*b* (37*a* and 37*b*) This multi-stage click switch is covered by upper and lower casings 34 and 31.

A pair of conductive pieces 22*a* and 22*b* (23*a* and 23*b*) are provided with in each pair of rubber contact portions 28*a* and 28*b* (29*a* and 29*b*), respectively, in opposed relation to the contact portions 41*a* and 41*b* (42*a* and 42*b*).

The two pressing portions 36*a* and 36*b* for sequentially depressing the pair of rubber contact portions 28*a* and 28*b* are formed on and project from the reverse surface of the operating knob 35 at one longitudinal end portion thereof (left end portion in FIG. 1), and the two pressing portions 37*a* and 37*b* for sequentially depressing the pair of rubber contact portions 29*a* and 29*b* are formed on and project from the reverse surface of the operating knob 35 at the other longitudinal end portion thereof (right end portion in FIG. 1).

The distal end of each of the pressing portions 36*a*, 36*b*, 37*a* and 37*b* is formed into such an inclined shape that when it abuts against the rubber contact portion 28*a*, 28*b*, 29*a*, 29*b*, its abutment surface is disposed generally perpendicularly to the pressing direction.

The operating knob 35 is pivotally supported by the pair of support shafts 33 and 33 formed on the housing 32. The operating knob, when pivotally moved in a clockwise direction (FIG. 1), advances the pressing portions 37*a* and 37*b*, thereby moving a window glass pane upward, and when this operating knob is pivotally moved in a counterclockwise direction, it advances the pressing portions 36*a* and 36*b*, thereby moving the window glass pane downward.

In the multi-stage click switch 21 in this first embodiment which is the switch for the power window, the two rubber contact portions 28*a* and 28*b*, disposed at the left end portion of FIG. 2 as indicated in an image line, are used for descending the window glass pane, and the two rubber contact portions 29*a* and 29*b*, disposed at the right end portion of FIG. 2, are used for ascending the window glass pane.

The rubber contact portion 28*a*, 29*a*, disposed at the upper portion of FIG. 2, is used for the first-stage switching operation, and the rubber contact portion 28*b*, 29*b*, disposed at the lower portion of FIG. 2, is used for the second-stage switching operation.

As shown in FIG. 3, a space between the rubber contact portion 28*a*, 29*a* for the first-stage switching operation and the opposing pressing portion 36*a*, 37*a*, and a space between the rubber contact portion 28*b*, 29*b* for the second switching operation and the opposing pressing portion 36*b*, 37*b* are different from each other so that the rubber contact portions 28*a* (29*a*) and 28*b* (29*b*) can be sequentially brought into contact with the switch contact portions 41*a* (42*a*) and 41*b* (42*b*) in accordance with the depressing operation of the operating knob 35. Therefore, the timing of contact of the first-stage rubber contact portion 28*a*, 29*a* with the corresponding pressing portion is different from the timing of contact of the second-stage rubber contact portion 28*b*, 29*b* with the corresponding pressing portion.

Figure 9:
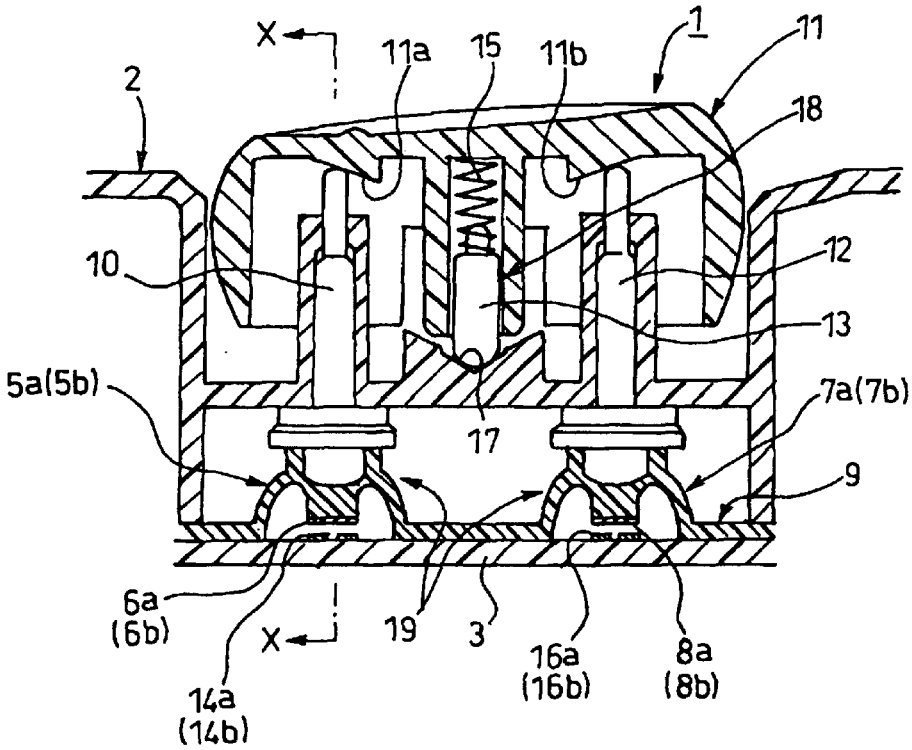
FIG. 9 is a vertical cross-sectional view of a related two-stage click switch.
Figure 10:
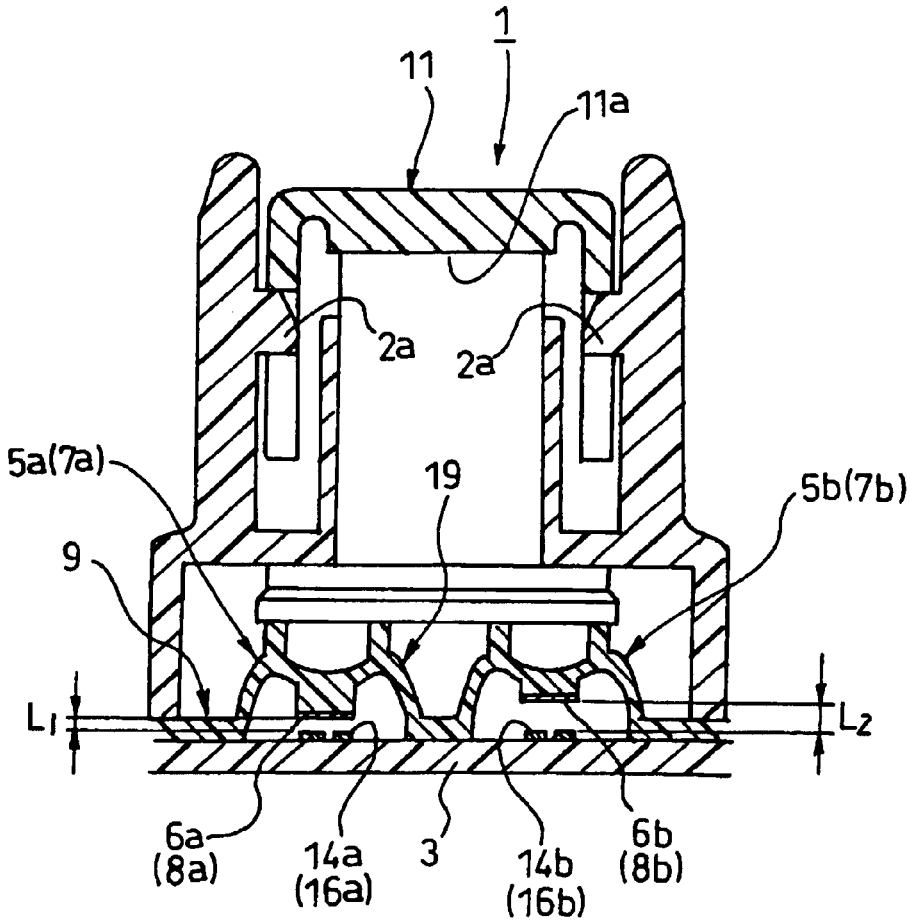
FIG. 10 is a vertical cross-sectional view taken along the line X—X of FIG. 9.

Unlike the rubber contact portions 5*a*, 5*b*, 7*a* and 7*b* shown in FIG. 9, each of the rubber contact portions 28*a*, 28*b*, 29*a* and 29*b* of this embodiment has a generally conical cross-section (as shown in FIG. 3) so that its resilient force, produced when it is elastically deformed upon descending of the corresponding pressing portion 36*a*, 36*b*, 37*a*, 37*b*, produces a suitable click feeling at the time of operating the operating knob 35.

In this first embodiment, each of the rubber contact portions 28*a* and 29*a*, other than the rubber contact portions 28*b* and 29*b* for effecting the final-stage (second-stage in this embodiment) switching operation, has overstroke means by which after its conductive piece 22*a*, 23*a* contacts the opposing switch contact portion 41*a*, 42*a*, the rubber contact portion 28*a*, 29*a* allows the forward movement of the pressing portion 36*a*, 37*a* because of its elastic deformation of a low resilient force, not producing a click feeling, until the final-stage switching operation by the rubber contact portion 28*b*, 29*b* is completed.

Namely, as shown in FIGS. 3 to 3B, the outer end portion (upper end portion in the drawings) of the rubber contact portion 28*a*, 29*a*, which can be pressed by the pressing portion 36*a*, 37*a*, is formed into a cylindrical tubular portion having an inner diameter larger than the outer diameter of the inner end portion (lower end portion in the drawings) having the conductive piece 22*a*, 23*a* mounted thereon. This cylindrical tubular portion is displaced downward uniformly around the inner end portion while flexing a thin wall portion 43 of a conical shape flaring from the outer end portion. With this construction, the rubber contact portion 28*a*, 29*a* has the overstroke means by which it can effect elastic deformation of a lower resilient force, not producing a click feeling, when its stroke exceeds a predetermined value.

In the construction having such overstroke means, when the pressing portion 36*a* (not shown) is further moved downward from the first-stage switch-operating condition shown in FIG. 5A, the outer end portion of the rubber contact portion 28*a* for effecting the first-stage switching operation can descend a distance S because of the low resilient-force elastic deformation of the thin wall portion 43, with the conductive piece 22*a* (formed on the inner end portion of this rubber contact portion 28*a*) held against the switch contact portion 41*a*, as shown in FIG. 5B, and thus the rubber contact portion 28*a* allows the downward movement of the pressing portion 36*a* without producing a click feeling.

The outer end portion of the rubber contact portion 28*b*, 29*b* for effecting the second-stage switching operation is formed into a solid construction, and is not provided with such overstroke means as described above for the rubber contact portions 28*a* and 29*a*.

Next, the operation of the multi-stage click switch 21 of this first embodiment will be described. In the initial condition of the multi-stage click switch 21 before the pressing operation, the outer end portion of the first-stage-operating rubber contact portion 28*a*, 29*a* is held in slight contact with the distal end of the opposing pressing portion 36*a*, 37*a* as shown in FIG. 1A, and the operating knob 35 is maintained in a neutral condition by resilient contact forces of the rubber contact portions 28*a* and 29*a*.

In this initial condition, the outer end portion of the second-stage-operating rubber contact portion 28*b*, 29*b* is spaced a small distance from the distal end of the opposing pressing portion 36*b*, 37*b*, as shown in FIG. 1B.

Figure 6A:
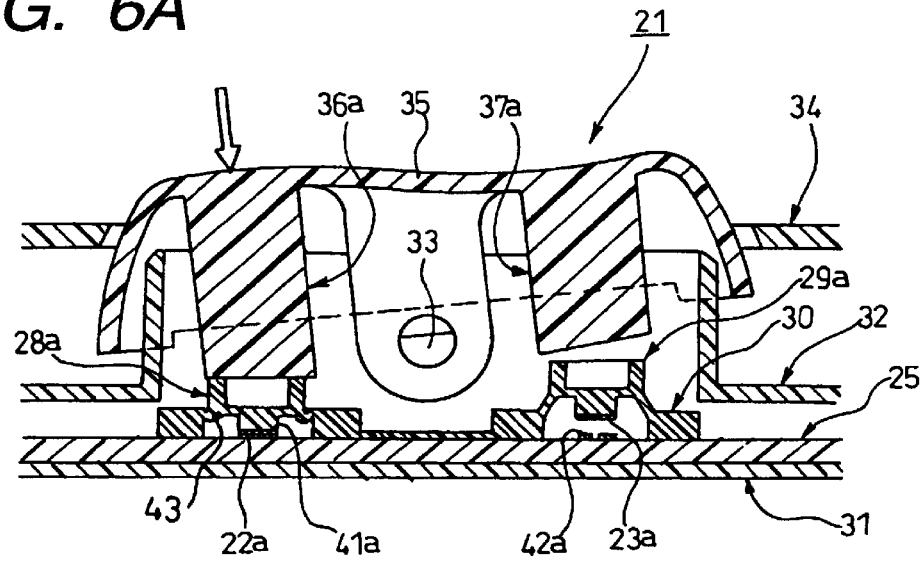
FIGS. 6A and 6B are vertical cross sectional views showing the positional relation between the rubber contact portion and a rubber switch pressing portion in a first-stage switch-operating condition of the multi-stage click switch of FIGS 1A and 1B.

In the initial condition of the multi-stage click switch 21, when the one end portion (left end portion in FIG. 6A) is pressed, so that the first-stage-operating rubber contact portion 28*a* is depressed a predetermined amount by the pressing portion 36 as shown in FIG. 6A. This rubber contact portion 28*a* produces a suitable click feeling by the resilient force of the elastically-deformed thin wall portion 43 at the time of operating the operating knob 35, and at the same time the conductive piece 22*a* is brought into contact with the switch contact portion 41*a*, thereby achieving the first-stage switch-operating condition.

Namely, when the thin wall portion 43 of the rubber contact portion 28*a* is elastically deformed in an amount larger than the predetermined value, this thin wall portion 43 is buckled, so that the resilient reaction force, transmitted to the operating knob 35, is reduced, and therefore the operator can perceive this as a click feeling representing the first-stage switching operation.

Figure 6B:
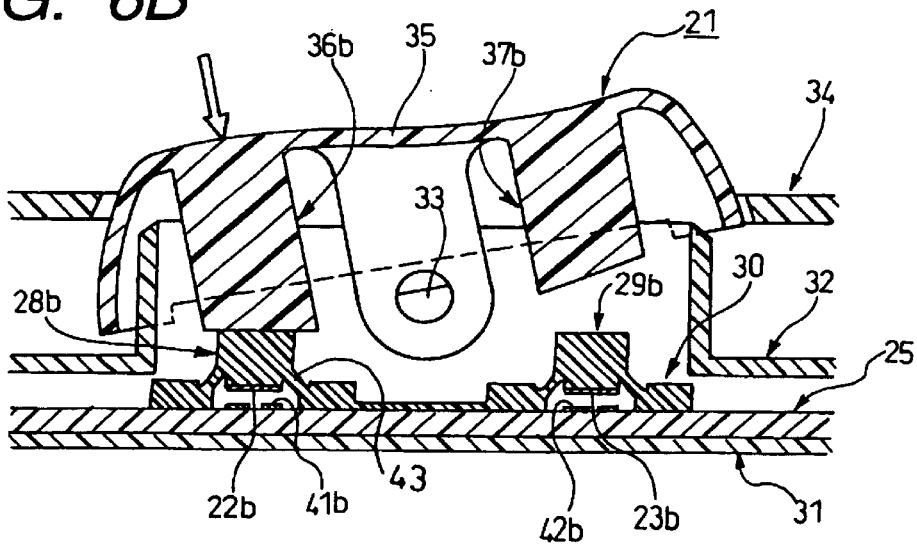

In this first-stage switch-operating condition, the pressing portion 36*b* is brought into contact with the outer end portion of the second-stage-operating rubber contact portion 28*b* for the first time as shown in FIG. 6B, and when the operating knob 35 is further pressed down, this rubber contact portion begins to be depressed.

When the operating knob 35 is further pressed down from the first-stage switch-operating condition, the first-stage-operating rubber contact portion 28*a* allows the downward movement of the pressing portion 36*a* because of the elastic deformation of the thin wall portion 43 (forming the overstroke means), with the conductive piece 22*a* held in contact with the switch contact portion 41*a*, as shown in FIG. 7.

Figure 7A:
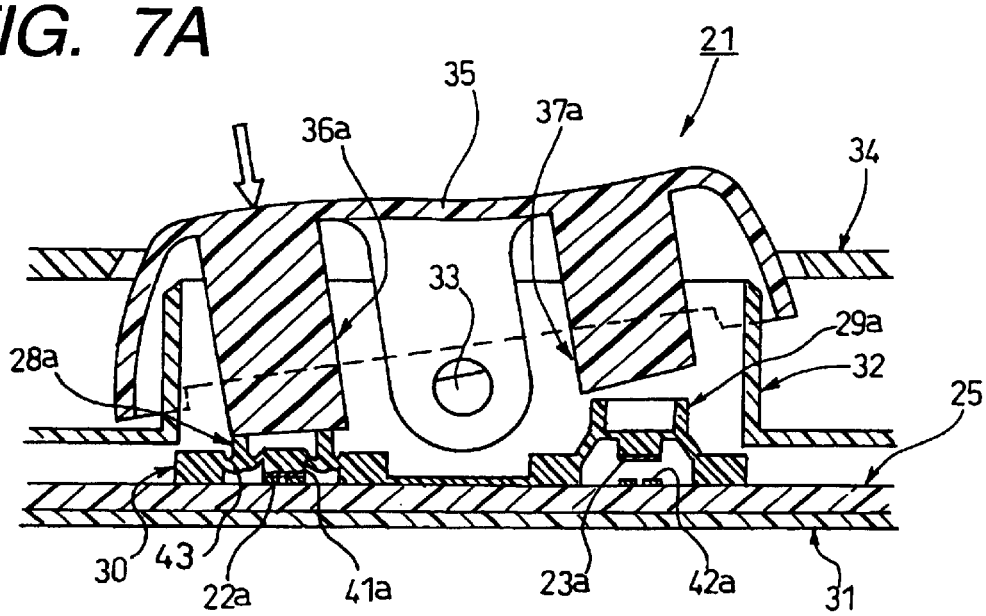
FIG. 7 is a cross-sectional view explanatory of the operation of the multi-stage click switch of FIG. 1.
Figure 7B:
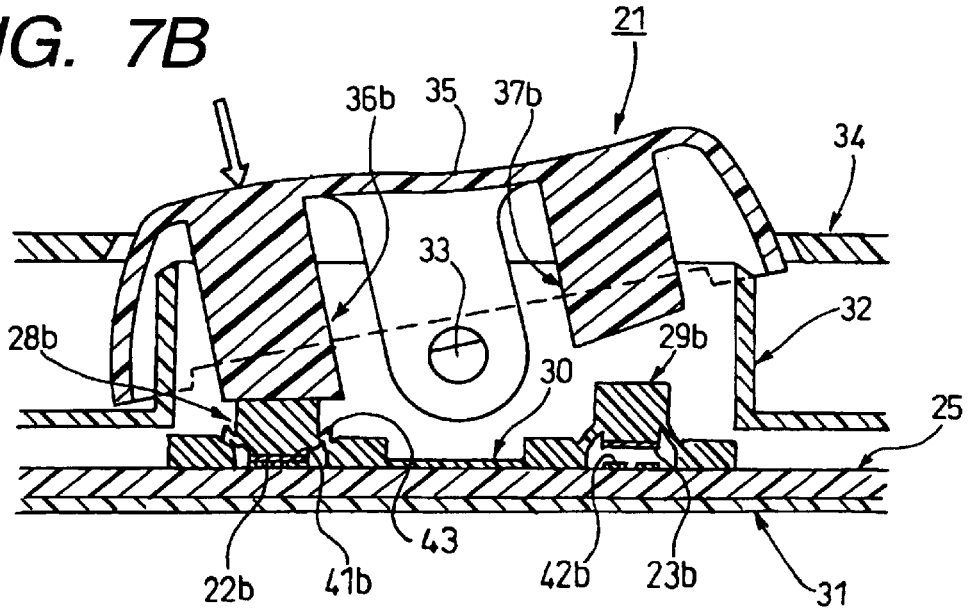

When the second-stage-operating rubber contact portion 28*b* is depressed by the pressing portion 36*b* in an amount larger than the predetermined value as shown in FIG. 7B, this rubber contact portion produces a suitable click feeling by the resilient force of an elastically-deformed thin wall portion 43 thereof at the time of operating the operating knob 35, and at the same time the conductive piece 22*b* is brought into contact with the switch contact portion 41*b*, thereby achieving a second-stage switch-operating condition.

Therefore, for example, when the operating knob 35 is pivotally moved in a counterclockwise direction (FIG. 1), the pressing portions 36*a* and 36*b* move forward, and the conductive piece 22*a* of the rubber contact portion 28*a* is first pressed into contact with the switch contact portion 41*a* (serving as the manually-descending contact portion) to achieve the first-stage operating condition, thereby rendering this switch contact portion into a conducting state. When this condition is maintained, the window glass pane is descending.

Then, when the operating knob 35 is returned to its initial position, the conductive piece 22*a* moves upward apart from the switch contact portion, so that the window glass pane ceases to descend. Alternatively, when the operating knob 35 is further pivotally moved through a predetermined angle in the counterclockwise direction, the thin wall portion 43 of the rubber contact portion 28*a*, having the overstroke means, is further flexed without producing a click feeling, and absorbs the stroke difference, and therefore the rubber contact portion 28*b* continues to de depressed, and the conductive piece 22*b* is pressed into contact with the switch contact portion 41*b* (serving as the automatically-descending contact portion) to achieve a second-stage operating condition, and the window glass pane automatically descends to a lower limit.

Namely, in the multi-stage click switch 21 of this first embodiment, a click feeling is produced by the reaction force produced as a result of elastic deformation of each of the rubber contact portions 28*a*, 28*b*, 29*a* and 29*b*. Therefore, it is not necessary to provide the click producing mechanism 18, comprising the special parts as in the related two-stage click switch 1 shown in FIG. 9.

Therefore, in the multi-stage click switch 21 in this first embodiment, the number of the component parts is reduced, and the time and labor, required for the assembling operation, is reduced, so that the production cost can be reduced. And besides, it is not necessary to provide a click producing mechanism, comprising separate members, between the operating knob 35 and the rubber switch member 30, and therefore the height dimension of the operating knob 35 can be reduced, so that the whole of the switch unit can be formed into a compact design.

By increasing the number of the rubber contact portions 28*a*, 28*b* . . . , a click feeling can be easily produced in a multi-stage manner, that is, two- or more stage manner.

Although the multi-stage click switch 21 of the first embodiment is the pivotally-moving switch which is operated by pressing the opposite end portions of the operating knob 35, the present invention is not limited to this multi-stage click switch.

Figure 8:
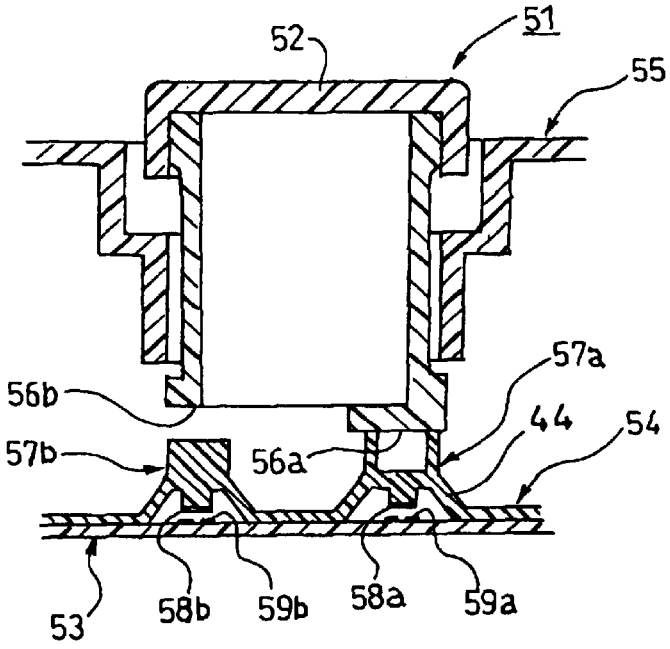
FIG. 8 is a vertical cross-sectional view of a second embodiment of a multi-stage click switch of the invention.

For example, a second embodiment of a push-type multi-stage click switch 51 of the present invention, shown in FIG. 8, comprises: a pair of pressing portions 56*a* and 56*b* of different heights mounted on a reverse surface of an operating button (operating knob) 52 upwardly and downwardly-movably mounted on a housing 55; a contact circuit member 53, which has a pair of switch contact portions 59*a* and 59*b* which are disposed in opposed relation to the pressing portions 56*a* and 56*b*; a rubber switch member 54 provided between the contact circuit member 53 and the pressing portions 56*a* and 56*b*; and a pair of rubber contact portions 57*a* and 57*b* which are formed on the rubber switch member 54, and can sequentially close and open the switch contact portions 59*a* and 59*b* in a two-stage manner in accordance with the forward and backward movement of the pressing portions 56*a* and 56*b*.

A resilient force, produced when each rubber contact portion 57*a*, 57*b* is elastically deformed by the forward movement of the pressing portion 56*a*, 56*b*, produces a suitable click feeling at the time of operating the operating button 52. Conductive pieces 58*a* and 58*b* are formed respectively on the inner sides of the rubber contact portions 57*a* and 57*b* in opposed relation to the switch contact portions 59*a* and 59*b*, respectively.

The first-stage switch-operating rubber contact portion 57*a*, operated by the pressing portion 56*a*, has overstroke means by which after its conductive piece 58*a* contacts the opposing switch contact portion 59*a*, the rubber contact portion 57*a* allows the forward movement of the pressing portion 56*a* because of its elastic deformation of a low resilient force, not producing a click feeling, until the second-stage switching operation of the rubber contact portion 57*b* by the pressing portion 56*b* is completed. As described above for the rubber contact portion 28*a* (29*a*) of the multi-stage click switch 21 of the first embodiment, this overstroke means is formed by a cylindrical tubular outer end portion of the rubber contact portion 57*a* and a thin wall portion 44 of a conical shape flaring from this outer end portion.

Namely, in the multi-stage click switch 51 of this second embodiment, a click feeling is produced by the resilient force produced when the rubber contact portion 57*a* itself is elastically deformed as in the multi-stage click switch 21 of the first embodiment.

Therefore, it is not necessary to provide a click producing mechanism, comprising special parts, and the number of the component parts, as well as the time and labor for the assembling operation, is reduced, so that the production cost can be reduced, and besides the whole of the switch unit can be formed into a compact design.

A click feeling can be produced in a multi-stage manner in accordance with the number of the rubber contact portions 57*a*, 57*b*.

In the multi-stage click switches 21 and 51 in the above embodiments, although the overstroke means is formed by the cylindrical tubular outer end portion of the rubber contact portion and the thin wall portion flaring from this outer end portion, this means of the present invention is not limited to this construction, but can take any other suitable form.

For example, there can be used a construction in which when a cylindrical tubular outer end portion of the rubber contact portion is pressed by a force larger than a predetermined value, this outer end portion itself is buckled and deformed so as to absorb the stroke difference between this rubber contact portion and the final-stage rubber contact portion.

In the multi-stage click switches 21 and 51 in the above embodiments, although an FPC (flexible printed circuit) is used as the contact circuit member 25, 53 in order to form the whole of the switch unit into a thinner design, any other suitable contact circuit member, such as a PCB (printed circuit board), can be used.

In the above-mentioned multi-stage click switch in the present invention, a click feeling is produced by the resilient force produced when the rubber contact portion itself is elastically deformed. Therefore, it is not necessary to provide a click producing mechanism, comprising special parts, as used in the related switch.

Therefore, the number of the component parts, as well as the time and labor for the assembling operation, is reduced, so that the production cost can be reduced. And besides, it is not necessary to provide such a click producing mechanism, comprising separate members, between the operating knob and the rubber switch member, and therefore the whole of the switch unit can be formed into a compact design.

A click feeling can be easily produced in a multi-stage manner in accordance with the number of the rubber contact portions.

Therefore, there can be provided the multi-stage click switch in which the number of the component parts is reduced, and the compact design can be achieved, and this click switch is inexpensive and highly reliable.

What is claimed is:

1. A multi-stage click switch comprising:

a housing;

an operating knob movably mounted on the housing;

a plurality of pressing portions provided on the operating knob;

a contact circuit member including a plurality of switch contact portions disposed in opposed relation to the plurality of pressing portions, respectively;

a rubber switch member provided between the plurality of pressing portions and the contact circuit member; and a plurality of rubber contact portions which are formed on the rubber switch member, and can sequentially close and open the switch contact portions in multi-stage manner in accordance with the movement of the plurality of pressing portions;

wherein each of the plurality of rubber contact portions includes a thin wall portion, an outer portion that is pressed by one of the pressing portions, and an inner portion on which is mounted a conductive piece opposed to corresponding one of the plurality of switch contact portions, wherein each of the thin wall portions produce a click feeling by a resilient force, produced by elastic deformation of the rubber contact portion during the movement of the operating knob, at the time of operating the operating knob; and wherein when the operating knob is moved from a first-stage switching operation to a final-stage switching operations;

a lower resilient force elastically deforms the thin wall portion of one of the rubber contact portions that are used for the first-stage switching operation, said outer portion of the one of the rubber contact portions is displaced downwardly to a position such that the outer portion is around said inner portion of the one of the rubber contact portions, and the thin wall portion of the one of the rubber contact portions that are used for the first-stage switching operation does not produce a click feeling.

2. The multi-stage slick switch according to claim 1, wherein the operating knob is pivotally mounted on the housing, and the plurality of pressing portions are formed on and project from a reverse surface of the operating knob at pivotally-moving opposite end portions thereof.

3. The multi-stage click switch of claim 1, wherein the thin wall portion is a generally conical shape.

4. The multi-stage click switch of claim 1, wherein said outer portion of the one of the rubber contact portions that is used for the first-stage switching operation is cylindrical, said inner portion of the one of the rubber contact portions that is used for the first-stage switching operation is cylindrical, and an inner diameter of the cylindrical outer portion is larger than an outer diameter of the cylindrical inner portion, and the cylindrical outer portion is capable of being displaced downwardly to a position such that the cylindrical outer portion is around the cylindrical inner portion.

5. The multi-stage click switch of claim 3, wherein said outer portion of the one of the rubber contact portions that is used for the first-stage switching operation is cylindrical, said inner portion of the one of the rubber contact portions that is used for the first-stage switching operation is cylindrical, and an inner diameter of the cylindrical outer portion is larger than an outer diameter of the cylindrical inner portion, and the cylindrical outer portion is capable of being displaced downwardly to a position such that the cylindrical outer portion is around the cylindrical inner portion.

* * * * *